US007999416B2

(12) United States Patent
Lalongé

(10) Patent No.: US 7,999,416 B2
(45) Date of Patent: Aug. 16, 2011

(54) MODULE FOR CONTROLLING A SWITCH IN A HIGH VOLTAGE ELECTRICAL SUBSTATION

(75) Inventor: Patrick Lalongé, McMasterville (CA)

(73) Assignee: Emergie H. T. International Inc., Boucherville, Quebec (CA)

( * ) Notice: Subject to any disclaimer, the term of this patent is extended or adjusted under 35 U.S.C. 154(b) by 549 days.

(21) Appl. No.: 12/102,352

(22) Filed: Apr. 14, 2008

(65) Prior Publication Data

US 2009/0256427 A1 Oct. 15, 2009

(51) Int. Cl.
*H01H 3/00* (2006.01)

(52) U.S. Cl. ..... 307/139

(58) Field of Classification Search ..... 702/64; 700/286; 361/93.2, 139, 71, 170; 307/139, 307/140, 143; 318/272; 251/129.01
See application file for complete search history.

(56) References Cited

U.S. PATENT DOCUMENTS

| | | | | |
|---|---|---|---|---|
| 2,181,080 | A | 11/1939 | Elston | |
| 4,419,667 | A * | 12/1983 | Gurr et al. | 340/3.1 |
| 4,428,022 | A | 1/1984 | Engel et al. | |
| 4,444,067 | A | 4/1984 | Preuss et al. | |
| 4,628,396 | A | 12/1986 | Flemming | |
| 4,804,809 | A | 2/1989 | Thompson, Jr. et al. | |
| 4,996,646 | A * | 2/1991 | Farrington | 700/293 |
| 5,025,171 | A | 6/1991 | Fanta et al. | |
| 5,034,584 | A | 7/1991 | Fanta et al. | |
| 5,099,382 | A | 3/1992 | Eppinger | |
| 5,224,011 | A * | 6/1993 | Yalla et al. | 361/93.2 |
| 5,254,814 | A | 10/1993 | Harr | |
| 5,388,451 | A | 2/1995 | Stendin et al. | |
| 5,834,909 | A | 11/1998 | Marmonier | |
| 5,859,398 | A | 1/1999 | McKean | |
| 6,362,445 | B1 | 3/2002 | Marchand et al. | |
| 6,466,420 | B1 | 10/2002 | Chuniaud et al. | |
| 6,531,841 | B1 | 3/2003 | Elli et al. | |
| 6,603,087 | B2 | 8/2003 | Österholm et al. | |
| 6,852,939 | B2 | 2/2005 | Rhein et al. | |

(Continued)

FOREIGN PATENT DOCUMENTS

| | | | |
|---|---|---|---|
| CA | 2472274 | A1 | 7/2003 |
| CA | 2431464 | A1 | 12/2003 |

OTHER PUBLICATIONS

Sugiyama, T.; Kameoka, S.; Maeda, K.; Kaneda, A.; Goda, T.; , "Development and Field Experience of Digital Protection and Control Equipment in Power Systems," Power Apparatus and Systems, IEEE Transactions on , vol. PAS-101, No. 11, pp. 4237-4244, Nov. 1982.*

International Search Report dated Jul. 8, 2009, issued in connection with International Patent Application No. PCT/CA2009/000453.

*Primary Examiner* — Jared J Fureman
*Assistant Examiner* — Daniel Cavallari
(74) *Attorney, Agent, or Firm* — Norton Rose OR LLP

(57) ABSTRACT

There is provided a method for operating a control module of a high voltage switch, the method comprising: interfacing with an external environment via an input/output unit that filters each electrical signal passing therethrough; analyzing incoming signals and triggering actions as a function of the incoming signals via a logical unit; powering the control module via an internal power unit that is supplied by an external power supply; and isolating the logical unit from the power unit and the input/output unit by having all signals coming from these units and directed to the logical unit pass through an isolation unit.

12 Claims, 4 Drawing Sheets

U.S. PATENT DOCUMENTS 6,921,989 B2 7/2005 Baranowski et al.
6,930,271 B1 8/2005 Palmieri et al.
7,003,602 B2 * 2/2006 Selz et al. ..... 710/100
7,377,480 B2 * 5/2008 Tabor et al. ..... 251/129.04
7,630,189 B2 * 12/2009 Lalonge ..... 361/160
2008/0217419 A1 * 9/2008 Ehlers et al. ..... 236/44 C

* cited by examiner

MODULE FOR CONTROLLING A SWITCH IN A HIGH VOLTAGE ELECTRICAL SUBSTATION

CROSS-REFERENCE TO RELATED APPLICATIONS

This is the first application filed for the present invention.

TECHNICAL FIELD

The present invention relates to the field of the supervision, control and protection of a high voltage electrical substation.

BACKGROUND OF THE INVENTION

An electrical substation is a subsidiary station of electricity generation, transmission and distribution where voltage is transformed from high to low or vice-versa using transformers. Electrical substations are usually provided with a control module which monitors and controls the different elements and functions of the substation. These elements comprise disconnectors, disconnect switches, circuit breakers and other high voltage switch gears. As electrical substations are operated with high voltage, the control modules have to be protected and isolated from this high voltage so that the components of the control module will not be damaged by electromagnetic interferences (EMIs) or radio frequency interferences (RFIs).

The protection of control modules is limited to voltage surges of the order of 1000-1500 V. Therefore, there is a need to provide control modules that safely operate in environments of higher voltage surges.

SUMMARY OF THE INVENTION

According to a first broad aspect of the present invention, there is provided a system for controlling a high voltage switch comprising: an input/output unit comprising a filtering system for each of a plurality of electrical signals passing through the input/output unit; a logical unit comprising a memory and a first processor, and adapted to be connected to an external power supply; an isolation unit comprising an isolation system for each of the plurality of electrical signals and for a voltage signal, the input/output unit, the isolation unit and the logical unit being electrically connected to transmit signals received by the input/output unit to the logical unit through the isolation unit and to transmit externally signals generated by the logical unit through the isolation unit and the input/output unit; and a power unit comprising a power board and a filter and isolation sub-unit, and adapted to be connected to the external power supply, the power unit being adapted to supply in power the input/output unit and the isolation unit through the filtering and isolation sub-unit, the high voltage switch and the power unit being electrically connected to the isolation unit to receive the voltage signal.

According to a second broad aspect of the present invention, there is provided a method for operating a control module of a high voltage switch, the method comprising: interfacing with an external environment via an input/output unit that filters each electrical signal passing therethrough; analyzing incoming signals and triggering actions as a function of the incoming signals via a logical unit; powering the control module via an internal power unit that is supplied by an external power supply; and isolating the logical unit from the power unit and the input/output unit by having all signals coming from these units and directed to the logical unit pass through an isolation unit.

It should be understood that the term "switch" is to include any type of disconnector, disconnect switch, circuit breaker, or switch gear that serves to open and close a circuit at high voltage.

It should be understood that the term "processor" is used to represent any circuit which can process data and/or signals. Central processing unit (CPU), microprocessors, and microcontrollers are examples of processors.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

The present control module is a system that monitors and controls any switch present in a high voltage environment and comprising an hydraulic, pneumatic or electromechanical. The control module enables the monitoring and the control of any system having motors, valves or pieces of equipment having any kind of movement such as a linear or rotary movement. For example, the control module operates a real time control of the opening and/or closing speed of a switch. The control module controls the opening or closing speed of the switch by varying the voltage applied to the switch. For example, the voltage can be applied to the motor controlling the arm of a disconnect switch or it can be applied to a pump controlling the gas/liquid pressure of circuit breaker.

The control module may control many aspects of the operation including, but not limited to, internal environmental conditions (such as temperature and humidity levels), a switch, alarms, inputs and outputs, internal tests, and information management.

According to an embodiment of the control module, the control module is protected from voltage surges of about 5000 V.

Particularly, the control module can control and adjust parameters such as the location of the arm of a disconnect switch or the gas/liquid pressure in a circuit breaker. Additionally, the control module can also control the temperature and/or humidity of the air in the control module.

The control module can communicate with its external environment which may include other control modules, operators, computers, sensors, pieces of equipments, etc.

Figure 1:
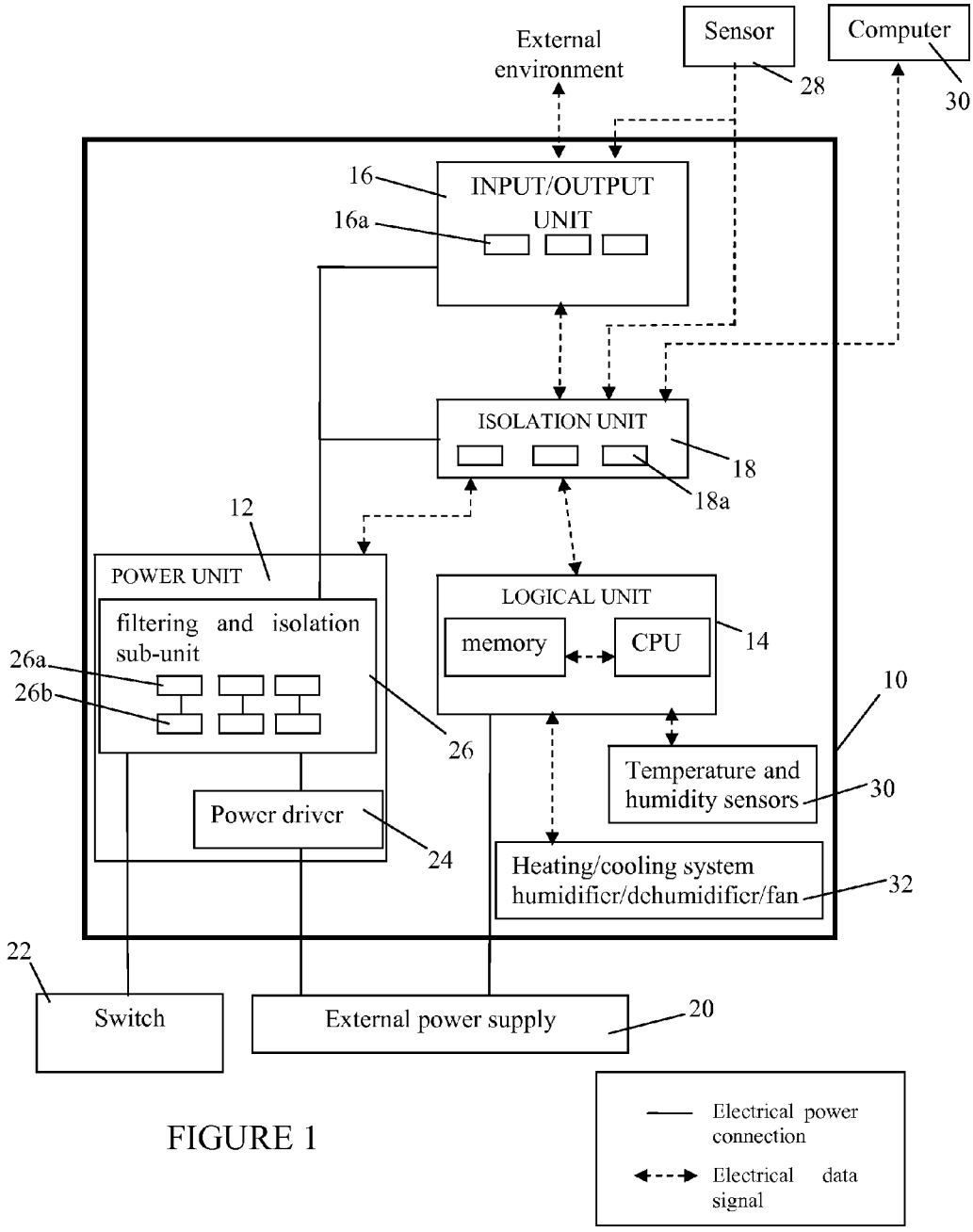
FIG. 1 is a block diagram of an embodiment of the control module comprising four units.

In an embodiment, the control module 10 comprises 4 units: a power unit 12, a logical unit 14, an input/output unit 16, and an isolation unit 18, as illustrated in FIG. 1. The power unit 12 receives the power supply external to the control module 10 and supplies power to the other units 16 and 18, except the logical unit 14 which is supplied directly by the external power supply 20. This unit 12 also supplies power to the switch 22 to be controlled by the control module 10.

In an embodiment, the power unit 12 comprises a power driver 24 and a filtering and isolation sub-unit 26. The power driver 24 is supplied by the external power supply 20 and supplies power to the switch 22 to be controlled, the isolation unit 18, and the input/output unit 16through the isolation and filtering sub-unit 26. The isolation (26*a*) and filtering (26*b*) realized by the filtering and isolation sub-unit 26 can be obtained using any technique known to a person skilled in the art.

In an embodiment of the control module 10, the power unit 12 and the logical unit 14 are supplied by an AC current and the power unit 12 generates AC currents to supply the different elements 22 to be controlled and the other units 16 and 18 of the control module 10.

In another embodiment, the power unit 12 and the logical unit 14 are supplied by a DC current and the power unit 12 generates DC currents to supply the different elements 22 to be controlled and the other units 16 and 18 of the control module 10. One skilled in the art would appreciate that the control module 10 can be supplied by an electrical generator.

Referring to FIG. 1, the input/output unit 16 represents the interface between the control module 10 and the external environment. In an embodiment, the inputs received by the input/output unit 16 include, but are not limited to, the signals coming from an operator, signals coming from other control modules and/or pieces of equipment and signals coming from sensors 28. For example, the signals coming from the operator can be signals ordering the control module 10 to open or close the switch 22 or signals asking information about the control module 10 or the switch 22. For example, the signals coming from other control modules and/or pieces of equipment can provide information about other switches, other control modules. They can also be alarm signals. The signals coming from sensors 28 indicate the performances of the piece of equipment 22 to be controlled. For example, the performances can include a pressure, a position or a current intensity.

In an embodiment, the signals coming from the sensors 28 go directly to the isolation unit 18 without passing through the input/output unit 16.

The input/output unit 16 also transmits signals directed towards the operator or other control modules and/or pieces of equipment of the substation. For example, the transmitted signals can be alarm signals or signals indicating the performances of the control module 10 or the switch 22. Furthermore, the input/output unit 16 executes the function of filtering the entering and exiting signals, isolating the control module from the external medium and protecting the control module from over-voltage.

The logical unit 14 analyses the control signals coming from the sensors 28, the command signals coming from the operator and the signals coming from the other control modules and/or pieces of equipment, takes decisions whether the voltage of the switch 22 to be controlled has to be adjusted or not and sends signals. The signals sent by the logical unit 14 include communication signals internal to the control module 10 and signals directed to the external environment. Signals indicating a voltage to be applied to the switch 22 are examples of internal communication signals. The analysis of the signals and the taking of decisions is performed by a processor. For example, if a voltage has to be varied, the logical unit 14 communicates to the power unit 12 through the isolation unit 18 the voltage that has to be applied.

In an embodiment, the logical unit 14 can also communicate with an external computer 30 and the communication signal passes through the isolation unit 18 before reaching or after leaving the logical unit 14.

In an embodiment, the processor can store about 5 measurements per second during a long period of time.

Referring to FIG. 1, the isolation unit 18 isolates the logical unit from the power unit 12 and the input/output unit 16. All signals entering or exiting the logical unit 14 pass by the isolation unit 18. The isolation unit 18 ensures the security of the logical unit 14 against EMIs and/or RFIs.

The isolation unit 18 which isolates the logical unit 14 from the remaining of the control module 10 can be of any kind known by a person skilled in the art. The isolation (18*a*) offered by this module 18 can be optical, mechanical and/or galvanic.

According to an embodiment, the control module 10 can receive numerical or analog signals.

In an embodiment, the control module 10 receives current signals in the range of 4-20 mA and protects them.

In an embodiment, the control module 10 further comprises sensors 30 which monitor its environmental conditions of operation such as the temperature and the humidity. Additionally, the control module 10 can adjust the temperature and/or the humidity of the cage comprising the control module 10. In this case, the sensors 30 communicate with the logical unit 14 through the isolation unit 18. The logical unit 14 takes decisions to whether or not the temperature and/or the humidity have to be adjusted. If so, the logical unit 14 communicates the voltage to be applied to the heating system and/or air conditioning system and/or humidifier and/or dehumidifier and/or fan 32 to the power unit 12 through the isolation unit 18. The sensors 30 can be located anywhere in the control module 10. For example, the sensors 30 can be placed in the power unit 12 and, in this case, the signals sent by the sensors 30 to the processor passes through the isolation and filtering subunit 26 before reaching the isolation unit 18.

In an embodiment, the power unit 12 can be supplied by a voltage in the range of 50 to 240 V either in DC or AC current conditions and can generate DC or AC voltages, respectively, in the same range to control the different switches of the substation.

In an embodiment, the operational ranges of the control module 10 are from 90 to 250 V under AC conditions and from 80 to 160 V under DC conditions.

The logical unit 10 comprises a processor which analyses the received data coming from sensors 18. These sensors 28 monitor an operating parameter and the performances of the piece of equipment 22 to be controlled. For example, the operating parameter can be the position of the arm of a disconnect switch or the gas/liquid pressure in the case of a circuit breaker. The processor stores the data and takes the decision to adjust or not the voltage applied to the piece of equipment 22. For example, if the piece of equipment 22 is a disconnect switch controlled by a motor, the logical module 14 will decide the voltage that has to be applied to the motor after receiving the order to open the disconnect switch.

When the processor receives the order to vary an operating parameter of the piece of equipment 22 to be controlled, the first step taken by the processor is the reading of the operating parameter. The different values that the operating parameter has to take in order to achieve the variation are stored in a memory. The processor reads the first value to be given to the operating parameter and transmits the voltage corresponding to the first value of the operating parameter to the power unit 12 through the isolation unit 18. The power unit 12 applies the voltage to the piece of equipment 22. The sensor 28 monitoring the operating parameter continuously transmits the value of the operating parameter to the processor. When the processor notices that the monitored value of the operating parameter corresponds to the first value of the operating parameter, the processor reads the second value to be given to the operating parameter stored in the memory and transmits the corresponding voltage to the power unit 12 which applies it to the piece of equipment 22. When the monitored operating parameter corresponds to the second value of the operating parameter, the processor reads the third value to be given to the operating parameter and transmits the corresponding voltage to the power unit 12. These steps are repeated until the task has been completed. These steps give a plurality of speeds to the opening or closing of the switch 22 and the speed depends on the type of switch being operated.

According to an embodiment, the location of an arm of a motorized disconnect switch is controlled by the control module 10. A sensor 28 indicates the location of the arm to the logical unit 14. The control module 10 receives the order to open the disconnect switch. The processor reads the first position of be given to the arm in the database stored in the memory and consequently transmits the corresponding voltage to the power unit 12 which applies it to the motor of the disconnect switch. The motor moves the arm of the disconnect switch. When the position monitored by the sensor corresponds to the target position, the processor reads the second value to be given to the arm and its corresponding voltage is transmitted to the power unit 12 which applies it to the motor of the disconnect switch. These steps are repeated until the disconnect switch is completely open. These steps give a plurality of speeds to the arm and the speed depends on the position of the arm, whether it is opening or closing.

Figure 2A:
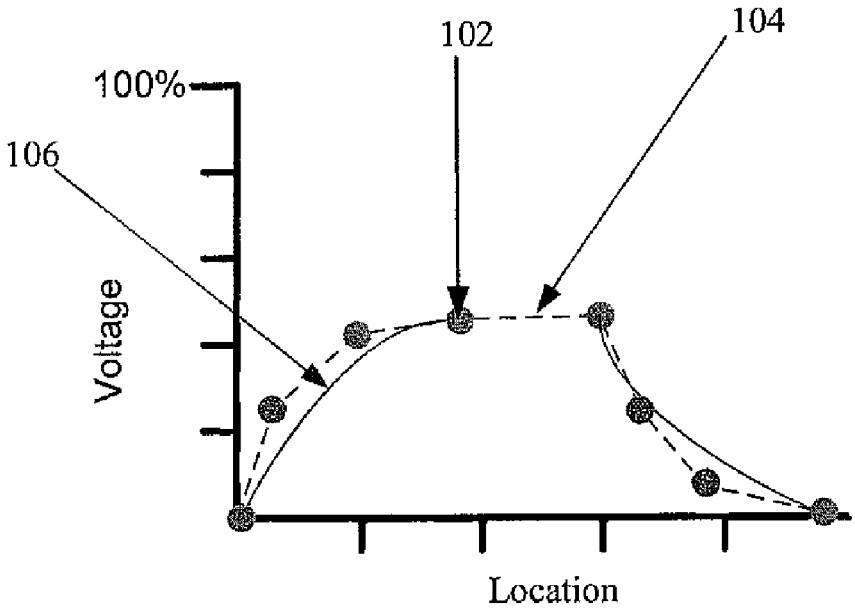
FIG. 2*a* is a graph of the voltage applied to a disconnect switch as a function of the location of the disconnect switch in which the rising edge of the curve has a logarithmic shape, in accordance with an embodiment of the present invention.

FIG. 2*a* illustrates the voltage applied to a disconnect switch as a function of the location of arm of the disconnect switch. The voltage is represented in percentage so that when a voltage of 0% is applied, the switch does not move. The points 102 are the different values of the location of the arm stored into the memory, for which a corresponding voltage is also stored in the memory. The processor reads successively the points 102 and transmits the corresponding voltage to be applied to the power unit 12. When the arm has reached a position corresponding to one of the points 102, the processor reads the next position value which corresponds to the next point 102 and transmits its corresponding voltage to be applied. The dashed line 104 represents the voltage curve that has to be applied to the switch. The line 106 is the voltage curve obtained by using the method described above.

FIG. 2*a* illustrates an embodiment of the closing of a disconnect switch. A high speed is immediately set and the arm moves quickly to reduce the duration of the arc being formed between the moving contact and the fixed contact of the switch. The speed is decreased when the arc is cut, which occurs when the moving contact comes into contact with the fixed contact. The arm is stopped when the fully closed position is reached.

Figure 2B:
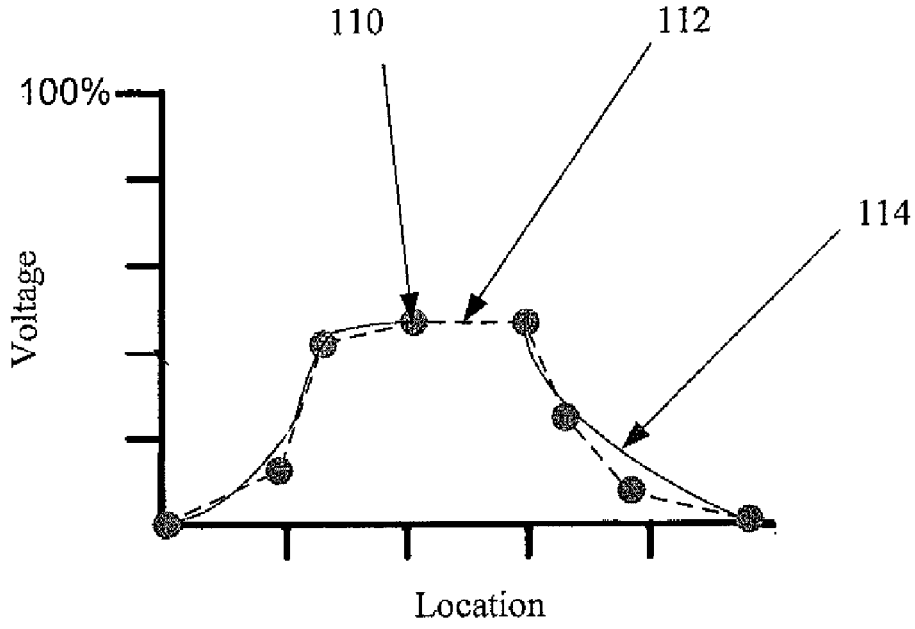
FIG. 2*b* is a graph of the voltage applied to a disconnect switch as a function of the location of the disconnect switch in which the rising edge of the curve has an exponential shape, in accordance with an embodiment of the present invention.

FIG. 2*b* illustrates another curve of voltage applied to another disconnect switch as a function of the location of the switch. As in FIG. 2*a*, the voltage is represented in percentage. The points 110 are the positions stored into the memory. When the arm has reached one this position, the processor reads the next one and applies the corresponding voltage through the power unit 12. The dashed line 112 represents the voltage curve that has to be applied to the switch. The line 114 is the voltage curve obtained by using the method described above.

FIG. 2*b* illustrates an embodiment of an opening of a disconnect switch. A first speed is set until the point when an arc forms between the moving contact and the fixed contact. At this moment, the arm is accelerated significantly until the arc breaks, after which the arm is decelerated until a fully open position. A brake may be activated to stop the arm completely.

FIGS. 2*a* and 2*b* illustrate how the curve of the voltage can be easily designed using the algorithm which consists in varying the voltage as a function of the position of the arm in order to vary the speed of the arm. In FIG. 2*a*, the rising edge of the curve 106 has a logarithmic shape where the rising edge of the curve 114 has an exponential shape in FIG. 2*b*.

It should be understood that the curve of the voltage can have any shape by using the method described above. It should be noted that the method above presented for the opening or closing of the arm of a disconnect switch is not restricted to a disconnect switch and can be apply to control the opening and closing speed of any type of switch present in an electrical substation.

According to an embodiment, the processor can also have a function of prediction of tear and wears. By only analyzing the evolution of additional operating parameters of the piece of equipment 22 to be controlled, the processor can predict damage to the piece of equipment 22. An example of the additional operating parameter can be the electric current applied to the motor of a disconnect switch. A higher current required to open or close switch is symptomatic of tear and wears.

At least one additional sensor is required to monitor the additional operating parameter. This sensor communicates the value of the additional operating parameter to the processor through the input/output unit 16 and the isolation unit 18. For a given value of the operating parameter, a threshold value of the additional operating parameter is stored in the memory. The processor compares the value of the additional operating parameter monitored by the additional sensor to the threshold value stored in the memory. If the monitored value exceeds the threshold value, the processor predicts a damage to the piece of equipment 22 and activates an alarm signal indicating that maintenance or replacement of the piece of equipment 22 is required.

Figure 3:
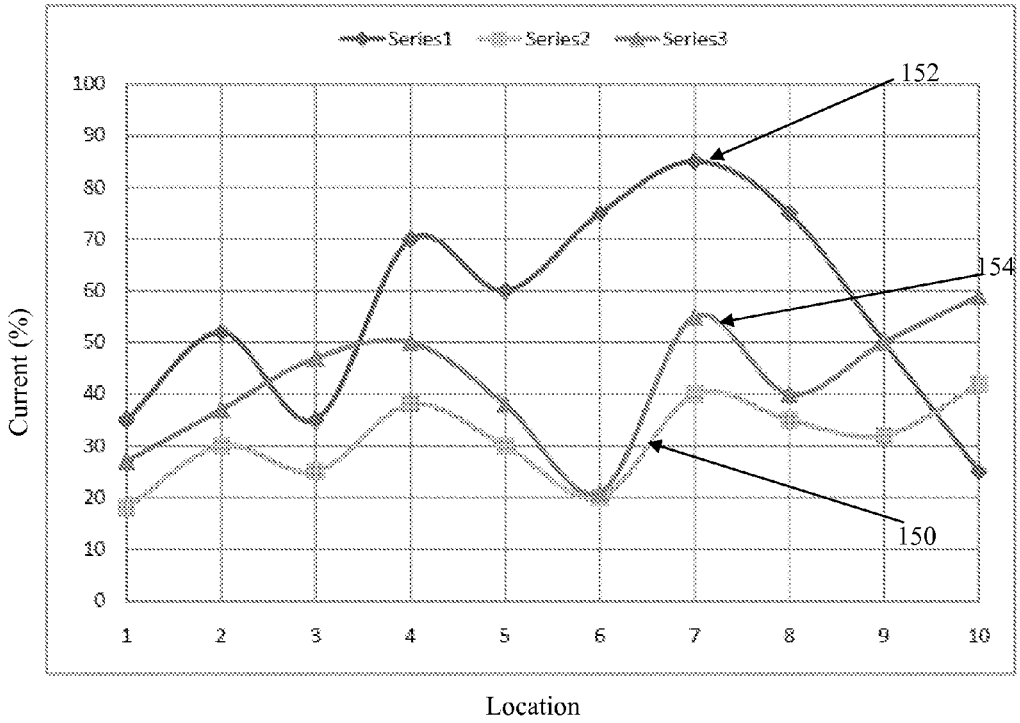
FIG. 3 is a graph of the current as a function of location, in accordance with an embodiment of the present invention.

According to an embodiment, the control module 10 controls a disconnect switch and the processor analyses the evolution in time of the current applied to the motor enabling the movement of the arm of a disconnect switch. In this case, an ampere meter monitors the current applied to the motor and transmits the current value to the processor. Because of EMIs in the electrical substation, the current applied to the motor of the arm can varied and affect the good functioning of the disconnect switch. The processor analyses the monitored value of the current and takes decisions. FIG. 3 illustrates the current applied to the motor as a function of the location of the arm. Line 154 represents the threshold values of the current as a function of the location of the arm. The values of line 154 are stored into the memory of the logical unit. The processor receives from the ampere meter the value of the current applied to the motor and compares them to the threshold values stored in the memory. If the monitored values correspond to line 150, the processor compares them to the threshold values corresponding to line 154 and concludes that the applied current is not dangerous for the good functioning of the disconnect switch. But if the monitored values correspond to line 152, the processor notices the applied current is higher than the threshold value. In this case, the processor activates an alarm signal.

It should also be understood that the logical unit 14 and the processor can control any motor, pump, valve or component having any kind of movement.

In an embodiment of the logical unit 14, a heater permits to maintain the temperature of the processor under operating conditions. As a result, the control module 10 can be located inside or outside an electrical substation. Furthermore, the control module 10 is resistant to extreme climatic conditions.

In an embodiment, the processor also control the temperature and/or the humidity of the control module 10. Temperature and/or humidity sensors monitor the temperature and/or humidity in the control module and communicate the temperature and/or humidity to the logical unit through the input/output unit and the isolation unit. The processor receives the measured temperature and/or humidity and compares them to threshold values. If the temperature and/or humidity are not within a tolerable range, the processor adjusts the temperature and/or humidity by varying the voltage applied to the heating system and/or air conditioning system and/or humidifier and/or dehumidifier and/or fan in order to bring the temperature and/or humidity within the tolerable range.

The input/output unit 16 offers a protection, an isolation and a filtration of all of the signals passing through it. These functions are achieved by an electrical circuit and each signal passing through the input/output unit has its own electrical circuit 16*a*. These signals include the control signals and the command signals. The electrical circuit 16*a* includes a protection module, a filtration module and an electrical relay therebetween.

Figure 4:
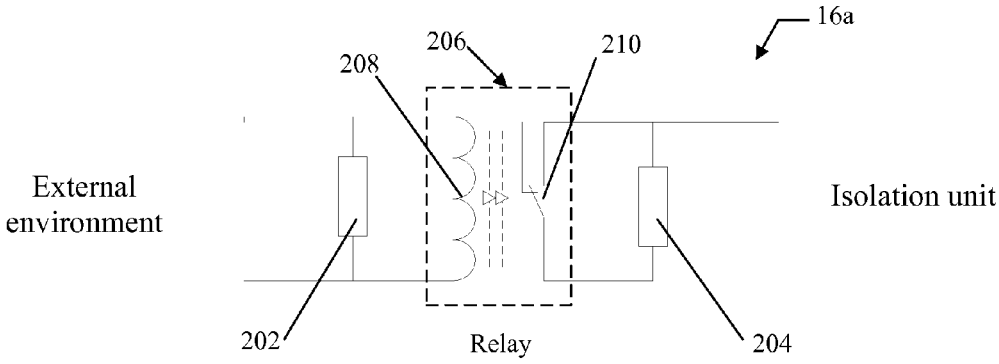
FIG. 4 illustrates an embodiment of the electrical circuit of the input/output unit for a signal entering the control module.

FIG. 4 illustrates an embodiment of the electrical circuit 16*a* of the input/output unit 16 for a signal entering the control module. The electrical circuit 16*a* includes a protection module 202, a filtration module 204 and an electrical relay 206 used as an isolation module therebetween. The protection module 202 protects the control module from surges and the filtration module 204 increases the quality of the entering signal. The electrical relay 206 includes a coil of actuators 208 and contacts 210.

It should be understood that any electrical relay known to a person skilled in the art can be used and falls within the scope of the present embodiment.

It should also be noted that any protection module which protects an electrical circuit from surges and any filter for increasing the quality of an electrical signal can be used and fall within the scope of the present embodiment.

Figure 5:
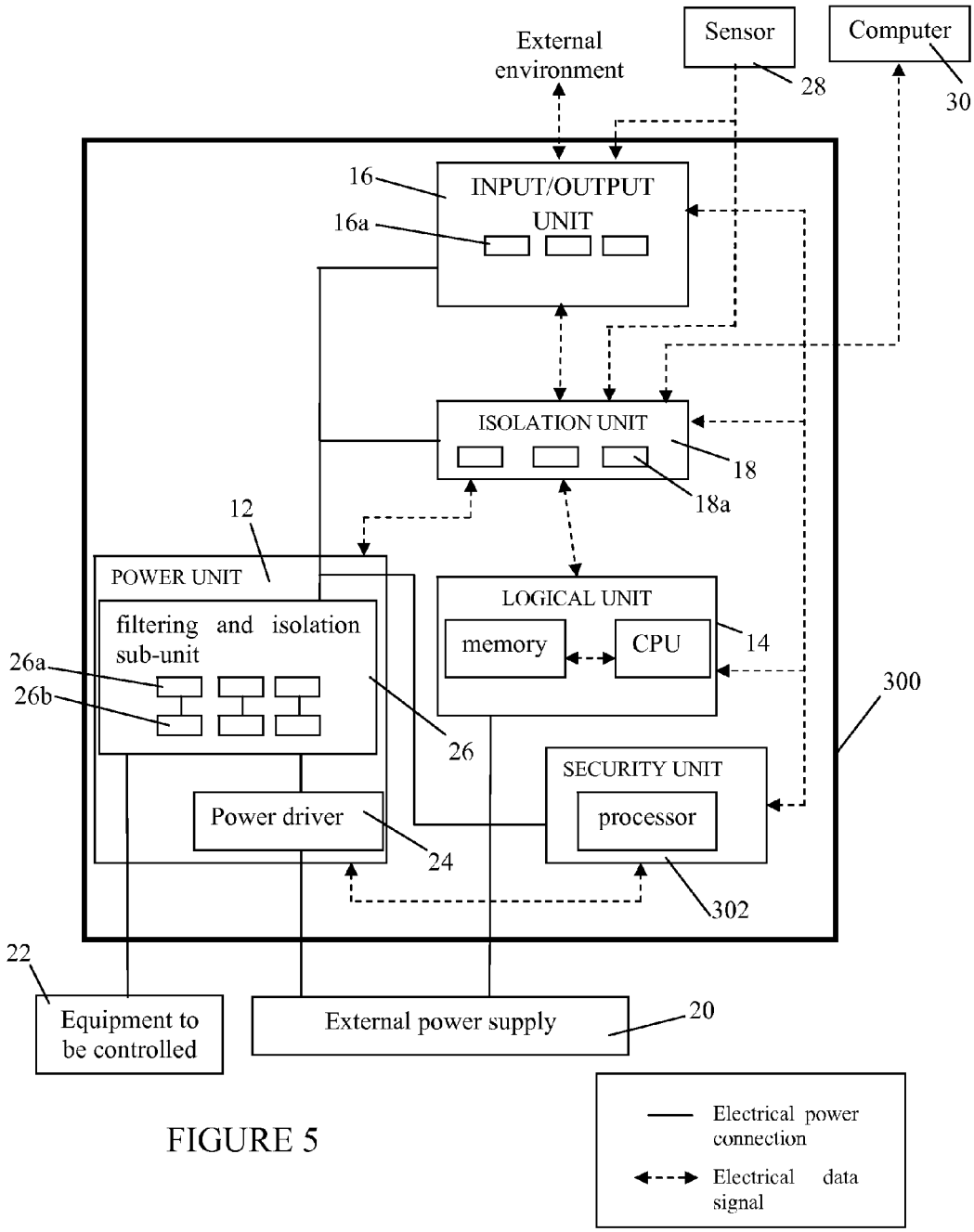
FIG. 5 is a block diagram of an embodiment of the control module comprising five units.

FIG. 5 illustrates an embodiment of the control module 300 which further comprises a security unit 302 in comparison to the control module 10 illustrated in FIG. 1. The security unit 302 is supplied in power by the power unit 12. The security unit 12 interacts directly with the input/output unit 16, the isolation unit 18, the logical unit 14, and the power unit 12. The security unit 302 detects any wear or malfunction that can occur in the other units 12, 14, 16, and 18 of the control module 300. Only the security unit 302 and the isolation unit 18 are directly connected to the logical unit 14.

If a unit 12, 14, 16, or 18 is deficient, the security unit 302 communicates the problem to the processor of the logical unit 14 which takes decisions. Alternatively, the security unit 302 activates an alarm and may also disconnect the control module 300.

If the logical unit 14 is deficient, the security unit 302 sends an alarm signal or disconnect the control module 300. The alarm signal is sent through the input/output unit 16.

In an embodiment, the security module 302 comprises a processor which analyses the functioning of the other units 12, 14, 16, and 18 and takes decision whether an alarm signal must be sent or a problem must be reported to the logical unit 14. Alternatively, the security unit 302 only comprises electronic digital circuits.

In another embodiment, the security unit can be integrated in the logical unit. In this case, the logical unit is further connected to the input/output unit and to the power unit. The processor of the logical unit also detects any tear or malfunction that can occur in the other units of the control module. The logical unit is directly related to the power unit, the isolation unit and the input/output unit to receive signals indicating their respective performances. If these signals go above or below threshold values stored in the memory, the logical unit may send an alarm signal and disconnect the control module.

The embodiments of the invention described above are intended to be exemplary only. The scope of the invention is therefore intended to be limited solely by the scope of the appended claims.

I claim:

1. A system for controlling a high voltage switch comprising:

an input/output unit for receiving control and command signals, the input/output unit comprising a protection circuit per control and command signal passing therethrough, the protection comprising a surge protector, a first filter, and a first isolator therebetween, and a logical unit connectable to an external power supply and comprising a memory and a processor, the processor configured for determining a voltage to be applied to the high voltage switch using the control and command signals, and transmitting a voltage signal indicative of the voltage to be applied in order to actuate the high voltage switch;

an isolation unit comprising a second isolator per control and command signal and for the voltage signal, the isolation unit connected between the input/output unit and the logical unit for transmitting the control and command signals from the input/output unit to the logical unit and receiving the voltage signal from the logical unit; and a power unit connectable to the external power supply and the high voltage switch and comprising a power driver and a filter and isolation sub-unit for powering the input/output unit, the isolation unit, and the high voltage switch through the filtering and isolation sub-unit, the power unit adapted to apply the voltage to the high voltage switch upon reception of the voltage signal from the isolation unit, the filtering and isolation sub-unit comprising a second filter and a third isolator per power signal sent to the input/output unit, the isolation unit, and the high voltage switch.

2. The system as claimed in claim 1, further comprising a security unit comprising a processing unit adapted to monitor security operation parameters of the power unit, the input/output unit, the logical unit, and the isolation unit and adapted to trigger an action when at least one of the security operation parameters is above a security threshold, the security unit being powered by the power unit through the filtering and isolation sub-unit.

3. The system as claimed in claim 2, wherein the security unit is adapted to send an alarm when at least one of the security operation parameters is above a security threshold value.

4. The system as claimed in claim 2, wherein the security unit is integrated into the logical unit.

5. The system as claimed in claim 1, wherein the processor is further configured for predicting tear and wears.

6. The system as claimed in claim 5, wherein the processor is configured for predicting the tear and wears from a current applied to a motor of the high voltage switch.

7. The system as claimed in claim 1, wherein the first isolator comprises a relay.

8. The system as claimed in claim 1, wherein the second isolator comprises one of a galvanic isolator, an optical isolator, and a mechanical isolator.

9. The system as claimed in claim 1, further comprising environmental sensors.

10. The system as claimed in claim 9, wherein the environmental sensors comprise a temperature sensor and a humidity sensor.

11. The system as claimed in claim 10, further comprising at least one of a heating system, an air conditioning system, a humidifier, a dehumidifier, and a fan for adjusting a temperature and a humidity.

12. The system as claimed in claim 1, wherein the high voltage switch comprises a motorized disconnect switch having an arm, and the processor is configured for determining the voltage to be applied to the high voltage switch as a function of the location of the arm.

* * * * *

UNITED STATES PATENT AND TRADEMARK OFFICE

CERTIFICATE OF CORRECTION

PATENT NO. : 7,999,416 B2
APPLICATION NO. : 12/102352
DATED : August 16, 2011
INVENTOR(S) : Lalonge It is certified that error appears in the above-identified patent and that said Letters Patent is hereby corrected as shown below:

The Title page, Item no. (73), should read Energie H. T. International Inc.

Signed and Sealed this
Eleventh Day of October, 2011

David J. Kappos

David J. Kappos
*Director of the United States Patent and Trademark Office*